US007829164B2

(12) United States Patent
Castellani et al.

(10) Patent No.: US 7,829,164 B2
(45) Date of Patent: Nov. 9, 2010

(54) UTILITY POLE OF THERMOPLASTIC COMPOSITE MATERIAL

(75) Inventors: Luca Castellani, Milan (IT); Stefano Testi, Milan (IT); Massimiliano Pavan, Milan (IT); Thomas Ponta, Milan (IT)

(73) Assignee: Pirelli & C. S.p.A., Milan (IT)

( * ) Notice: Subject to any disclaimer, the term of this patent is extended or adjusted under 35 U.S.C. 154(b) by 0 days.

(21) Appl. No.: 12/083,078

(22) PCT Filed: Oct. 7, 2005

(86) PCT No.: PCT/EP2005/010825

§ 371 (c)(1),
(2), (4) Date: Aug. 3, 2009

(87) PCT Pub. No.: WO2007/042858

PCT Pub. Date: Apr. 19, 2007

(65) Prior Publication Data

US 2009/0324951 A1 Dec. 31, 2009

(51) Int. Cl.
*B29C 47/00* (2006.01)

(52) U.S. Cl. ..... 428/36.9; 428/297.4; 428/299.4; 264/150; 264/148; 264/209.3

(58) Field of Classification Search ..... 428/36.9, 428/297.4, 299.4, 35.7; 264/148, 150, 171.26, 264/209.1, 209.3, 211.13
See application file for complete search history.

(56) References Cited

U.S. PATENT DOCUMENTS

| | | | | |
|---|---|---|---|---|
| 3,013,584 | A | 12/1961 | Reed et al. | |
| 3,853,418 | A | 12/1974 | Druin et al. | |
| 4,803,819 | A | 2/1989 | Kelsey | |
| 5,286,564 | A | 2/1994 | Cecchin et al. | |
| 5,414,040 | A | 5/1995 | McKay et al. | |
| 5,484,835 | A | 1/1996 | Sobajima et al. | |
| 5,658,519 | A | 8/1997 | March et al. | |
| 5,679,424 | A * | 10/1997 | Skaletz et al. | 428/35.7 |
| 5,919,953 | A | 7/1999 | Bossard et al. | |
| 6,824,863 | B1 * | 11/2004 | Kitayama et al. | 428/299.7 |
| 7,179,522 | B2 * | 2/2007 | Hiel et al. | 428/300.7 |
| 2002/0161072 | A1 | 10/2002 | Jacoby et al. | |
| 2004/0228995 | A1 | 11/2004 | Boaz et al. | |
| 2009/0324951 | A1 * | 12/2009 | Castellani et al. | 428/401 |

FOREIGN PATENT DOCUMENTS

| | | | |
|---|---|---|---|
| DE | 103 10 721 | A1 | 7/2005 |
| EP | 0 206 794 | B1 | 12/1986 |
| EP | 0 373 660 | B1 | 6/1990 |

(Continued)

*Primary Examiner*—N. Edwards
(74) *Attorney, Agent, or Firm*—Finnegan, Henderson, Farabow, Garrett & Dunner, L.L.P.

(57) ABSTRACT

A utility pole includes a thermoplastic composite material including: (a) at least one olefin polymer; and (b) at least one reinforcing fiber material embedded in the at least one olefin polymer, the thermoplastic composite material having a specific tensile strength higher than or equal to 15 MPa/(gr/cm$^3$), preferably 20 MPa/(gr/cm$^3$) to 200 MPa/(gr/cm$^3$), and more preferably 30 MPa/(gr/cm$^3$) to 150 MPa/(gr/cm$^3$) and a specific tensile modulus higher than or equal to 2000 MPa/(gr/cm$^3$), preferably 2500 MPa/(gr/cm$^3$) to 20000 MPa/(gr/cm$^3$), and more preferably 3000 MPa/(gr/cm$^3$) to 15000 MPa/(gr/cm$^3$).

70 Claims, 4 Drawing Sheets

FOREIGN PATENT DOCUMENTS

| | | | |
|---|---|---|---|
| EP | 0 400 333 | B1 | 12/1990 |
| WO | WO 00/16962 | | 3/2000 |
| WO | WO 00/16963 | | 3/2000 |
| WO | WO 00/26268 | | 5/2000 |
| WO | WO 00/44991 | | 8/2000 |
| WO | WO 01/22662 | A1 | 3/2001 |
| WO | WO 2004/103684 | A1 | 12/2004 |
| WO | WO2008030969 | * | 3/2008 |

* cited by examiner

I - I'

II - II'

UTILITY POLE OF THERMOPLASTIC COMPOSITE MATERIAL

CROSS REFERENCE TO RELATED APPLICATION

This application is a national phase application based on PCT/EP2005/010825, filed Oct. 7, 2005, the content of which is incorporated herein by reference.

BACKGROUND OF THE INVENTION

1. Field of the Invention

The present invention relates to a utility pole.

In particular, the present invention relates to a utility pole, more in particular to a telecommunication pole, including a thermoplastic composite material, so as to said thermoplastic composite material.

Moreover, the present invention also relates to a process for manufacturing said utility pole.

2. Description of the Related Art

Electrical transmission wires, telephone wires and lighting installations are often supported on utility poles. Such poles must be capable of withstanding not only columnar load applied by the weight of the object supported thereon but also the bending load imposed by eccentric loading and by wind. As a general rule, wooden, concrete or steel poles have been used for this purposes. However, these poles present some disadvantages.

Wooden poles, for example, are subject to rot, i.e. to decomposition from the action of bacteria or fungi, and to pest attack, i.e. wood boreers and pecking fowl. Unfortunately, wooden poles are subjected to rot both at and below the ground surface which can result in a pole collapsing or toppling, sometimes without warning. To avoid this type of degradation, the wooden poles are usually treated with chemicals which are intended to protect and to prolong the useful life of the same. However, said chemicals may leach out of the poles so causing both a reduction of their protective ability and environmental problems. Moreover, the wooden poles are heavy and, consequently, their installation, in particular in inaccessible places, is difficult and expensive.

Steel poles are subject to rust and therefore need constant attention and maintenance. The rust proofing compounds normally used may also have a deleterious effect on the environment. Also steel poles are heavy and are not easily manipulated. Moreover, steel poles are electrically conductive and, even though extreme care may be taken to insulate the electrical installations from the poles, storm damages may result in the poles becoming electrified. Finally, also steel poles are expensive.

Concrete poles are even heavier than steel poles. As a result, the expenses of transporting and handling concrete poles may be excessive. They are, therefore, often constructed in fairly proximity to the installation site. Concrete poles, like the wooden and steel poles abovementioned, are subjected to environment damages, in particular concrete tends to crack as a consequence of temperature changes.

In order to overcomes all the above-mentioned disadvantages, fiber reinforced plastic (FRP) poles have been suggested in the prior art as an excellent replacement for wooden, steel and/or concrete poles.

For example, U.S. Pat. No. 4,803,819 relates to a reinforced hollow utility pole of thermoset fiber-reinforced resin, of substantially uniform overall cross-sectional dimension throughout its length, integrally-formed by the process of pultrusion. Said fiber reinforced resin consists essentially of a glass fiber reinforced resin system selected from the group consisting of isophthalic polyester, vinyl ester and epoxy. The abovementioned pole is said to have the following advantages:

- it is formed in one piece to any desired length and it has a substantially uniform cross-section;
- it is resistant to animal and insect damages and natural deterioration such as, for example rotting;
- it is light and safe and allow the operators to install the same in a easier way and with a minimum hazard of possible short circuits.

Moreover, the insulating properties, strength and resilience of the abovementioned pole make it safe against strikes by lightening and wind damages, thus preventing wide spread utility failure due to storms.

International Patent Application WO 01/022662 relates to an elongated support structure, suitable for outdoor use as a utility pole, post or piling, including an elongated core formed of a substantially homogeneous composite material and a reinforcing layer bonded to the outer surface of the core. The composite material from which the core is formed includes a matrix resin and a strengthening material of fine, elongated particles. The strengthening material intermixed with the resin is fibers of a length in a range of about 0.50-4.00 inches (12, 7-101 mm). Such fibrous material may be produced from wood shreds, coconut husks, palm bark, hemp, sisal, or bagasse from which substantially all moisture, resins and sap has been removed. The resin in which the strengthening material is mixed may be phenolic or polymeric resins that are cured by heat. The abovementioned elongated support structure is said to have many advantages such as, for example:

- it reduces sources of chemical contamination in the environment;
- it is economic to transport, to install and to maintain;
- it is resistant to environmental degradation from rot, insect and weathering;
- it has an enhanced resistance to failure under compressive and flexural loads.

United States Patent Application US 2004/0228995 relates to a process for making a composite pole including the steps of shaping an integral mandrel in the form desired for the pole's interior and then applying a plurality of layers of reinforced composite material to the integral mandrel to form a pole including the composite material and the integral mandrel. A composite pole comprising an integral mandrel therein is also disclosed. The reinforced composite material includes a matrix component and a reinforcing component. The matrix component is a resinous material selected from epoxies, polyesters, acrylics, phenolics, or urea-formaldehyde resins which cure to form a bond with the reinforcing component. The reinforcing component is a fibrous material selected form fiberglass, aramid fibers, carbon fibers, or any other fibers which may be used for making fiber-reinforced plastics. The term fiber refer refers to a single homogeneous strand of material having a length of at least 5 mm, which can be spun into a yarn or roving, or made into a fabric. The use of a integral mandrel in making a pole simplifies the pole manufacture because it is not necessary to extract the reinforced composite tube from the mandrel. Moreover, for a given pole strength, less wall thickness is required and fewer layers of reinforced composite need to be applied.

However, the composite poles described above may still have some disadvantages.

For example, the composite poles above disclosed being made of cured composite materials are not easily recyclable at the end of their life. Moreover, the processes for manufacturing said composite poles (i.e. pultrusion or filament winding) are complex and have a slow production rate: consequently, productivity of the manufacturing plant is very low and, therefore, costs of the final products increase. Furthermore, said processes, in particular the filament winding process, require the use of solvents (for example, styrenic solvents) which, because of their toxicity, lead to risks for both the environment and the health of the operators.

SUMMARY OF THE INVENTION

The Applicant has faced the problem of obtaining utility poles of a thermoplastic composite material. In particular, the Applicant has faced the problem of obtaining utility poles of a thermoplastic composite material having low weight and which are able to withstanding not only the columnar load applied by the weight of the object supported thereon but also the bending load imposed by eccentric loading and by wind.

The Applicant has now found that it is possible to obtain utility poles of thermoplastic composite material having low weight and improved mechanical resistance with respect to both vertical and bending loads, by using a thermoplastic composite material endowed with specific mechanical properties, in particular specific tensile strength and specific tensile modulus. Said utility poles, besides presenting all the advantages of the utility poles of the cited prior art such as, for example:

- low weight;
- reduced sources of chemical contamination in the environment;
- low costs of transport, installation and maintenance;
- resistance to environmental degradation from rot, insect and weathering;
- enhanced resistance to failure under compressive and flexural loads;

are easily recyclable at the end of their life.

Moreover, said utility poles may be manufactured by means of a manufacturing process having high production rates and which does not require the use of harmful products (such as, for example, solvents): consequently, a higher productivity, a lower environment impact, and lower costs of the final products, are achieved.

According to a first aspect, the present invention relates to a utility pole including a thermoplastic composite material comprising:

(a) at least one olefin polymer;

(b) at least one reinforcing fiber material embedded in said at least one olefin polymer;

said thermoplastic composite material having a specific tensile strength higher than or equal to 15 MPa/(gr/cm$^3$), preferably of from 20 MPa/(gr/cm$^3$) to 200 MPa/(gr/cm$^3$), more preferably of from 30 MPa/(gr/cm$^3$) to 150 MPa/(gr/cm$^3$) and a specific tensile modulus higher than or equal to 2000 MPa/(gr/cm$^3$), preferably of from 2500 MPa/(gr/cm$^3$) to 20000 MPa/(gr/cm$^3$), more preferably of from 3000 MPa/(gr/cm$^3$) to 15000 MPa/(gr/cm$^3$).

Said specific tensile strength is the tensile strength measured according to standard ISO 527-1:1993, at 23° C., divided by the density measured, at 23° C., according to standard ISO 1183-3:1999.

Said specific tensile modulus is the tensile modulus measured according to standard ISO 527-1:1993, at 23° C., divided by the density measured, at 23° C., according to standard ISO 1183-3:1999.

Further details regarding the above disclosed measurement methods will be given in the examples which follows.

According to a further aspect, the present invention relates to a thermoplastic composite material comprising:

(a) at least one olefin polymer;

(b) at least one reinforcing fiber material embedded in said at least one olefin polymer;

said thermoplastic composite material having a specific tensile strength higher than or equal to 15 MPa/(gr/cm$^3$), preferably of from 20 MPa/(gr/cm$^3$) to 200 MPa/(gr/cm$^3$), more preferably of from 30 MPa/(gr/cm$^3$) to 150 MPa/(gr/cm$^3$) and a specific tensile modulus higher than or equal to 2000 MPa/(gr/cm$^3$), preferably of from 2500 MPa/(gr/cm$^3$) to 20000 MPa/(gr/cm$^3$), more preferably of from 3000 MPa/(gr/cm$^3$) to 15000 MPa/(gr/cm$^3$).

According to one preferred embodiment, said thermoplastic composite material has a heat deflection temperature (HDT) higher than 80° C., preferably of from 90° C. to 180° C.

Said heat deflection temperature (HDT) is measured according to standard ISO 75-1:2004.

According to one preferred embodiment, said thermoplastic composite material may further comprise at least one compatibilizing agent (c).

According to one preferred embodiment, said utility pole has a substantially circular cross-section.

According to a further preferred embodiment, said utility pole has a substantially non-circular cross-section (for example, substantially square cross-section, substantially hexagonal cross-section, substantially octagonal cross-section).

According to a further preferred embodiment, said utility pole has an effective cross-section area which is substantially constant along the utility pole total length (l).

According to a further preferred embodiment, said utility pole has an effective cross-section area which decreases along at least one length portion ($l_0$) of the utility pole total length (l).

For the aim of the present description and of the claims which follow, the term "effective cross-section area" is referred to the annular portion of the total cross-section area of the utility pole on a plane normal to the utility pole longitudinal axis which is occupied by the thermoplastic composite material.

According to one preferred embodiment, the decrease of said effective cross-section area along at least one length portion ($l_0$) of the utility pole total length (l) may be obtained by maintaining substantially constant the thickness of the thermoplastic composite material along the utility pole total length (l) and varying the external diameter of the utility pole along at least one length portion ($l_0$) of the utility pole total length (l).

According to a further preferred embodiment, the decrease of said effective cross-section area along at least one length portion ($l_0$) of the utility pole total length (l) may be obtained by maintaining substantially constant the external diameter along the utility pole total length (l) and varying the thickness of the thermoplastic composite material along at least one length portion ($l_0$) of the utility pole total length (l).

According to a further preferred embodiment, the decrease of said effective cross-section area along at least one length portion ($l_0$) of the utility pole total length (l) may be obtained by varying both the external diameter of the utility pole along at least one length portion ($l_0$) of the utility pole total length (l) and the thickness of the thermoplastic composite material along at least one length portion ($l_0$) of the utility pole total length (l).

In the case of a utility pole having a substantially non-circular cross-section is considered, said "external diameter" represents the diameter of the circle which circumscribes said substantially non-circular cross-section.

According to a further preferred embodiment, said length portion ($l_0$) is comprised from 20% to 100%, preferably from 40% to 90%, with respect to the utility pole total length (l).

According to a further preferred embodiment, said effective cross-section area decreases from the lower end to the upper end of said at least one length portion ($l_0$).

According to a further preferred embodiment, said effective cross-section area continuously decreases from the lower end to the upper end of said at least one length portion ($l_0$).

According to a further preferred embodiment, said utility pole has a frusto-conical external shape.

According to a further preferred embodiment, a utility pole having a height of from 6 m to 10 m, has an effective cross-section area having a value of from 1000 $mm^2$ to 30000 $mm^2$, preferably of from 2000 $mm^2$ to 20000 $mm^2$.

According to one preferred embodiment, said at least one olefin polymer (a) has a melting temperature higher than or equal to 115° C., preferably of from 130° C. to 200° C.

Said melting temperature may be determined by known techniques such as, for example, by Differential Scanning Calorimetry and corresponds to the second melting peak.

According to a further preferred embodiment, said at least one olefin polymer (a) has a tensile strength, measured according to standard ISO 527-1:1993, at 23° C., higher than or equal to 20 MPa, preferably of from 25 MPa to 50 MPa.

According to a further preferred embodiment, said at least one olefin polymer (a) has a tensile modulus, measured according to standard ISO 527-1:1993, at 23° C., higher than or equal to 800 MPa, preferably of from 1000 MPa to 2500 MPa.

According to a further preferred embodiment, said at least one olefin polymer (a) has a density measured, at 23° C., according to standard ISO 1183-3:1999, higher than or equal to 0.830 $g/cm^3$, preferably of from 0.890 $g/cm^3$ to 1.20 $g/cm^3$.

According to a further preferred embodiment, said at least one olefin polymer (a) has a Melt Flow Index (MFI), measured according to standard ASTM D1238-00, of from 0.05 g/10 min to 15 g/10 min, preferably of from 0.1 g/10 min to 10 g/10 min.

Further details regarding the above disclosed measurement methods will be given in the examples which follows.

According to one preferred embodiment, said at least one olefin polymer (a) is present in the thermoplastic composite material in an amount of from 30% by weight to 95% by weight, preferably of from 35% by weight to 80% by weight, with respect to the total weight of the thermoplastic composite material.

According to one preferred embodiment, said at least one olefin polymer (a) is selected from aliphatic and/or aromatic olefin homopolymers or copolymers, or mixtures thereof.

For the aim of the present description and of the claims which follows, the term "aliphatic olefin" generally means an aliphatic olefin of formula (I):

$$CH_2{=}CH{-}R \qquad (I)$$

wherein R represents a hydrogen atom, or a linear or branched alkyl group containing from 1 to 12 carbon atoms.

Specific examples of aliphatic olefin of formula (I) are: ethylene, propylene, 1-butene, isobutylene, 1-pentene, 1-hexene, 3-methyl-1-butene, 3-methyl-1-pentene, 4-methyl-1-pentene, 4-methyl-1-hexene, 4,4-dimethyl-1-hexene, 4,4-dimethyl-1-pentene, 4-ethyl-1-hexene, 3-ethyl-1-hexene, 1-octene, 1-decene, 1-dodecene, 1-tetradecene, 1-hexadecene, 1-octadecene, 1-eicosene, or mixture thereof. Of these, preferred are: ethylene, propylene, 1-butene, 1-hexene, 1-octene, or mixtures thereof.

For the aim of the present description and of the claims which follows, the term "aromatic olefin" generally means an olefin of formula (II):

$$CH_2{=}CH{-}(R_1R_2C)_x{-}(C_6H_{5-z})_y(R_3)_z \qquad (II)$$

wherein $R_1$, $R_2$ and $R_3$, which may be equal to or different from each other, represent a hydrogen atom or a linear or branched alkyl group containing from 1 to 8 carbon atoms; or $R_3$, different from $R_1$ and $R_2$, represents an alkoxy group, a carboxyl group, an acyloxy group, said acyloxy group optionally being substituted with alkyl groups containing from 1 to 8 carbon atoms or hydroxyl groups or halogen atoms; x is 0 or an integer of from 1 to 5 inclusive; y is 1 or 2; and z is 0 or an integer of from 1 to 5.

Specific examples of aromatic olefins of formula (II) are styrene; mono- or polyalkylstyrenes such as, for example, 4-methylstyrene, dimethylstyrene, ethylstyrene, vinyltoluene; styrene derivatives containing functional groups such as, for example, methoxystyrene, ethoxystyrene, vinylbenzoic acid, methyl vinylbenzoate, vinylbenzyl acetate, hydroxystyrene, chlorostyrene, divinylbenzene; phenyl-substituted alkenes such as, for example, allylbenzene, 4-phenylbutene-1,3-phenyl-butene-1,4-(4-methylphenyl)butene-1,4-(3-methylphenyl)butene-1,4-(2-methylphenyl)butene-1,4-(4-ethylphenyl)butene-1,4-(4-butylphenyl)butene-1,5-phenylpentene-1,4-phenylpentene-1,3-phenylpentene-1,5 (4-methylphenyl)pentene-1,4-(2-methylphenyl)-pentene-1, 3-(4-methylphenyl)pentene-1,6-phenyl-hexene-1,5-phenylhexene-1,4-phenylhexene-1,3-phenyl-hexene-1,6-(4-methylphenyl)hexene-1,5-(2-methylphenyl)hexene-1,4-(4-methylphenyl)hexene-1,3-(2-methylphenyl)hexene-1,7-phenylheptene-1,6-phenylheptene-1,5-phenylheptene-1,4-phenylheptene-1,8-phenyloctene-1,7-phenyloctene-1,6-phenyloctene-1,5-phenyloctene-1,4-phenyloctene-1,3-phenyloctene-1,10-phenyldecene-1; or mixtures thereof. Of these, preferred are: styrene, vinyltoluene, or mixtures thereof.

According to a further preferred embodiment, said aliphatic olefin homopolymers or copolymers are selected from: high-density polyethylene (HDPE) (d=0.940-0.970 $g/cm^3$), propylene homopolymers or copolymers of propylene with ethylene and/or with at least one α-olefin comonomer having the following formula $CH_2{=}CH{-}R$, in which R represents a linear or branched alkyl group containing from 4 to 12 carbon atoms, with an overall content of ethylene and/or α-olefin lower than 10% by mole, or mixtures thereof. Copolymers of propylene with ethylene, or mixtures thereof are particularly preferred.

Examples of aliphatic olefin homopolymers or copolymers which may be used in the present invention and which are currently commercially available are the products Moplen® HP 501D, Moplen® EP 2S30B, or Metocene® from Basell.

According to a further preferred embodiment, said aromatic olefin homopolymers or copolymers are selected from: polystyrene, ethylene/styrene copolymers, or mixtures thereof. Polystyrene is particularly preferred.

Examples of aromatic olefin homopolymers or copolymers which may be used in the present invention and which are currently commercially available are the products Questra® from Dow, or Edistir® from Polimeri Europa.

According to a further preferred embodiment, said aliphatic and/or aromatic olefin copolymers may be selected from heterophase copolymers comprising a thermoplastic phase made from a homopolymers of one or more aliphatic or aromatic olefin and an elastomeric phase made from a copolymer of ethylene with an α-olefin, wherein said elastomeric phase is preferably present in an amount not higher than 40% by weight relative to the total weight of the heterophase copolymer, or mixtures thereof.

Said heterophase copolymers are usually obtained by sequential copolymerization of: (i) aliphatic or aromatic olefin, preferably propylene, optionally containing small amounts of at least one olefinic comonomer selected from ethylene and α-olefins other than propylene; and then of: (ii) a mixture of ethylene with an α-olefin, in particular propylene, and optionally with small amounts of a polyene, in particular a diene. The copolymerization is usually carried out in the presence of Ziegler-Natta catalysts based on halogenated titanium compounds supported on magnesium chloride in admixture with an aluminium trialkyl compound wherein the alkyl groups contains from 1 to 9 carbon atoms such as, for example, aluminium triethyl or aluminium triisobutyl. Said heterophase copolymers are also commonly known as "thermoplastic reactor elastomers".

More details regarding the preparation of the heterophase copolymer are given, for example, in European Patent Applications EP 400,333 and EP 373,660 and in U.S. Pat. No. 5,286,564.

Preferably, the thermoplastic phase of said heterophase copolymers, mainly produced during the abovementioned phase (i) of the process, consists of a propylene homopolymer or a copolymer of propylene with an olefinic comonomer selected from ethylene and α-olefins other than propylene. Preferably, the olefinic comonomer is ethylene. The amount of olefinic comonomer is preferably less than 10 mol % relative to the total number of monomer moles in the thermoplastic phase.

Preferably, the elastomeric phase of said heterophase copolymers, mainly produced during the above-mentioned phase (ii) of the process, is not higher than 40% by weight, more preferably not higher than 25% by weight, relative to the total weight of the heterophase copolymer, and consists of an elastomeric copolymer of ethylene with an α-olefin and optionally with a polyene. Said α-olefin is preferably propylene; said polyene is preferably a diene. The diene optionally present as comonomer generally contains from 4 to 20 carbon atoms and is preferably selected from: linear (non-)conjugated diolefins such as, for example, 1,3-butadiene, 1,4-hexadiene, 1,6-octadiene, or mixtures thereof; monocyclic or polycyclic dienes, for example 1,4-cyclohexadiene, 5-ethylidene-2-norbornene, 5-methylene-2-norbornene, or mixture thereof. The composition of the elastomeric phase is generally as follows: from 15 mol % to 85 mol % of ethylene; from 85 mol % to 15 mol % of an α-olefin, preferably propylene; from 0 mol % to 5 mol % of a polyene, preferably a diene.

Preferably, the elastomeric phase consists of an elastomeric copolymer of ethylene and propylene having the following composition: from 15% by weight to 80% by weight, more preferably from 20% by weight to 40% by weight, of ethylene; from 20% by weight to 85% by weight, more preferably from 60% by weight to 80% by weight, of propylene, with respect to the total weight of the elastomeric phase.

The amount of elastomeric phase present in the heterophase copolymers may be determined by known techniques, for example by extracting the elastomeric (amorphous) phase with a suitable organic solvent (in particular xylene at 135° C. at reflux for 20 min): the amount of elastomeric phase is calculated as the difference between the initial weight of the sample and the weight of the dried residue.

The amount of propylene units in the elastomeric phase may be determined by extraction of the elastomeric phase as described above (for example with xylene at 135° C. at reflux for 20 min), followed by analysis of the dried extract according to known techniques, for example by infrared (IR) spectroscopy.

Example of heterophase copolymers which may be used in the present invention and which are currently commercially available are the products Moplen® EP 310D from Basell, or BorECO™ BA212E from Borealis.

According to one preferred embodiment, said at least one reinforcing fiber material (b) has an average length lower than or equal to 5 mm, preferably of from 0.01 mm to 4 mm.

According to a further preferred embodiment, said at least one reinforcing fiber material (b) has an aspect ratio (L/D wherein L is the average maximum dimension of the fiber and D is the average minimum dimension of the fiber) higher than 2, preferably of from 3 to 1000.

According to one preferred embodiment, said at least one reinforcing fiber material (b) is selected from discontinuous fibers such as, for example, glass fibers, wood fibers, cellulosic fibers, aramid fibers, carbon fibers, or mixtures thereof. Glass fibers, wood fibers, or mixtures thereof are particularly preferred.

According to one preferred embodiment, said at least one reinforcing fiber material (b) is present in the thermoplastic composite material in an amount of from 5% by weight to 70% by weight, preferably of from 200% by weight to 65% by weight, with respect to the total weight of the thermoplastic composite material.

As disclosed above, in order to improve the compatibility between the olefin polymer (a) and the reinforcing fiber material (b), the thermoplastic composite material according to the present invention may further comprise at least one compatibilizing agent (c).

According to one preferred embodiment, said at least one compatibilizing agent (c) is selected from functionalized aliphatic and/or aromatic olefin homopolymers or copolymers containing functional groups selected from: carboxylic groups, anhydride groups, ester groups, silane groups, epoxy groups. The amount of functional groups present in the above disclosed functionalized homopolymers or copolymers is generally comprised between 0.05 parts and 50 parts by weight, preferably between 0.1 parts and 10 parts by weight, based on 100 parts by weight of the functionalized homopolymers or copolymers.

The functional groups may be introduced during the production of the homopolymers or copolymers, by co-polymerization with corresponding functionalized monomers containing at least one ethylene unsaturation, or by subsequent modification of the homopolymers or copolymers by grafting said functionalized monomers in the presence of a free radical initiator (in particular, an organic peroxide). Said grafting may also be advantageously made "in situ" during the production of the thermoplastic composite material according to the present invention.

Alternatively, it is possible to introduce the functional groups by reacting pre-existing groups of the homopolymers or copolymers with a suitable reagent, for instance by an epoxidation reaction of a diene polymer containing double bonds along the main chain and/or as side groups with a peracid (for instance, m-chloroperbenzoic acid or peracetic acid) or with hydrogen peroxide in the presence of a carboxylic acid or a derivative thereof.

Functionalized monomers which may be used include for instance: silanes containing at least one ethylene unsaturation; epoxy compounds containing at least one ethylene unsaturation; monocarboxylic or, preferably, dicarboxylic acids containing at least one ethylene unsaturation, or derivatives thereof, in particular anhydrides or esters.

Examples of silanes containing at least one ethylene unsaturation are: 3-aminopropyl-triethoxysilane, γ-methacryloxypropyltri-methoxysilane, allyltrimethoxysilane, allyltriethoxysilane, allyl-methyldimethoxysilane, allylmethyldiethoxysilane, methyltriethoxysilane, methyltris (2-methoxyethoxy)-silane, dimethyldiethoxysilane, vinyltris (2-methoxy-ethoxy)silane, vinyltrimethoxysilane, vinylmethyl-dimethoxysilane, vinyltriethoxysilane, octyltriethoxysilane, isobutyltrimethoxy-silane, isobutyltriethoxy-silane, or mixtures thereof.

Examples of epoxy compounds containing at least one ethylene unsaturation are: glycidyl acrylate, glycidyl methacrylate, itaconic acid monoglycidyl ester, maleic acid glycidyl ester, vinylglycidyl ether, allylglycidyl ether, or mixtures thereof.

Examples of monocarboxylic or dicarboxylic acids containing at least one ethylene unsaturation are: maleic acid, maleic anhydride, fumaric acid, citraconic acid, itaconic acid, acrylic acid, methacrylic acid, and anhydrides or esters derived therefrom, or mixtures thereof. Maleic anhydride is particularly preferred.

Examples of compatibilizing agents (c) which may be used in the present invention and which are currently commercially available are the products Fusabond® from DuPont, Polybond® from Crompton, Orevac® from Elf Atochem, Exxelor® from Exxon Chemical, or Yparex® from DSM.

According to one preferred embodiment, said at least one compatibilizing agent (c) is present in the thermoplastic composite material in an amount of from 0% by weight to 10% by weight, preferably of from 0.01% by weight to 6% by weight, with respect to the total weigth of the thermoplastic composite material.

In order to improve the impact strength of the thermoplastic composite material according to the present invention, said thermoplastic composite material may further comprise at least one copolymer of ethylene with at least one aliphatic α-olefin, and optionally a diene (d). Preferably, said copolymer is characterized by a molecular weight distribution (MWD) index of less than 5, preferably between 1.5 and 3.5, and by a melting enthalpy ($\Delta H_m$) of not less than 30 J/g, preferably between 34 J/g and 130 J/g.

Said molecular weight distribution index is defined as the ratio between the weight-average molecular weight ($M_w$) and the number-average molecular weight ($M_n$) and may be determined, according to conventional techniques, by gel permeation chromatography (GPC).

Said melting enthalpy ($\Delta H_m$) may be determined by Differential Scanning Calorimetry and relates to the melting peaks detected in the temperature range from 0° C. to 200° C.

The aliphatic α-olefin and the diene may be advantageously selected from those above reported.

The copolymer of ethylene with at least one aliphatic α-olefin may be obtained by copolymerization of ethylene with an aliphatic α-olefin, preferably 1-octene, in the presence of a single-site catalyst such as, for example, a metallocene catalyst or of a so-called "Constrained Geometry Catalyst".

The synthesis of the copolymers of ethylene with at least one aliphatic α-olefin in the presence of metallocene catalysts is described, for example, in European Patent Application EP 206,794.

The synthesis of copolymers of ethylene with at least one aliphatic α-olefin in the presence of catalysts so-called "Constrained Geometry Catalyst" is described, for example, in International Patent Application WO 00/26268; or in U.S. Pat. No. 5,414,040.

Examples of copolymers of ethylene with at least one aliphatic α-olefin and optionally a diene (d) which may be used in the present invention and which are currently commercially available are the products Engage® from Dow, or Exact® from Exxon Chemical.

According to one preferred embodiment, said at least one copolymer of ethylene with at least one aliphatic α-olefin and optionally a diene (d) is present in the thermoplastic composite material in an amount of from 0% by weight to 30% by weight, preferably of from 1% by weight to 25% by weight, with respect to the total weigth of the thermoplastic composite material.

The thermoplastic composite material according to the present invention may further comprises conventional additives such as lubricants, fillers, pigments, plasticizers, surface-modifying agents, UV absorbers, antioxidants, hindered amine or amide light stabilizers, flame-retardants, nucleating agents, or mixtures thereof.

Said thermoplastic composite material may be made according to processes known in the art. For example, said thermoplastic composite material may be made by mixing the olefin polymer (a), the reinforcing fiber material (b) and the compatibilizing agent (c) optionally present, with the other compound optionally present, according to techniques known in the art. Alternatively, the reinforcing fiber (b) may be pre-treated with the compatibilizing agent (c) before being added to the olefin polymer (a).

The mixing may be carried out, for example, using a single-screw extruder or a co-rotating or counter-rotating twin-screw type extruder. The obtained thermoplastic composite material may then be extruded and pelletized according to usual techniques.

Further details about the preparation of said thermoplastic composite material may be found, for example, in United States Patent Application US 2002/0161072, or in U.S. Pat. Nos. 5,919,953 and 5,484,835.

The utility pole according to the present invention may be produced by means of an extrusion process. In particular, the utility pole may be made by means of an extrusion process comprising:

- feeding the thermoplastic composite material into at least one extruder comprising a housing, at least one screw rotatably mounted into said housing including at least one feed opening and a discharge opening;
- mixing and melting said composite material;
- extruding the melted composite material through a variable extrusion die head to obtain an extruded profile;
- calibrating the obtained extruded profile by means of a calibrating device;
- cooling the obtained extruded profile;
- cutting the obtained extruded profile to obtain the utility pole.

The thermoplastic composite material may be prepared by means of a preliminary mixing process or, alternatively, the components of the thermoplastic composite material may be separately fed to the extruder and mixed therein.

According to one preferred embodiment, said extrusion process is carried out continuously.

According to one preferred embodiment, said mixing and melting step is carried out at a temperature of from 160° C. to 240° C., preferably of from 170° C. to 230° C.

According to a further preferred embodiment, said extrusion process may further comprise the step of extruding at least one coating layer onto said extruded profile. Said coating layer may be laid externally and/or internally to said extruded profile. Said further extrusion step may be advantageously carried out by co-extrusion of said coating layer and said extruded profile by means of at least two extruders all connected to a common double extrusion head.

Preferably, said coating layer comprises at least one olefin polymer which may be selected from those above disclosed. Preferably, said coating layer may further comprise at least one conventional additive which may be selected from those above disclosed.

Said coating layer may have a substantially constant or a variable thickness along the utility pole total length (l).

Preferably, said coating layer has a thickness of from 0.1 mm to 2 mm, more preferably of from 0.3 mm to 1.0 mm.

Further details about said extrusion process may be found, for example, in the following International Patent Applications: WO 00/16962, WO 00/16963, or WO 2004/103684.

BRIEF DESCRIPTION OF THE DRAWINGS

The present invention will now be illustrated in further detail by means of the attached figures wherein.

DETAILED DESCRIPTION OF THE INVENTION

Figure 1:
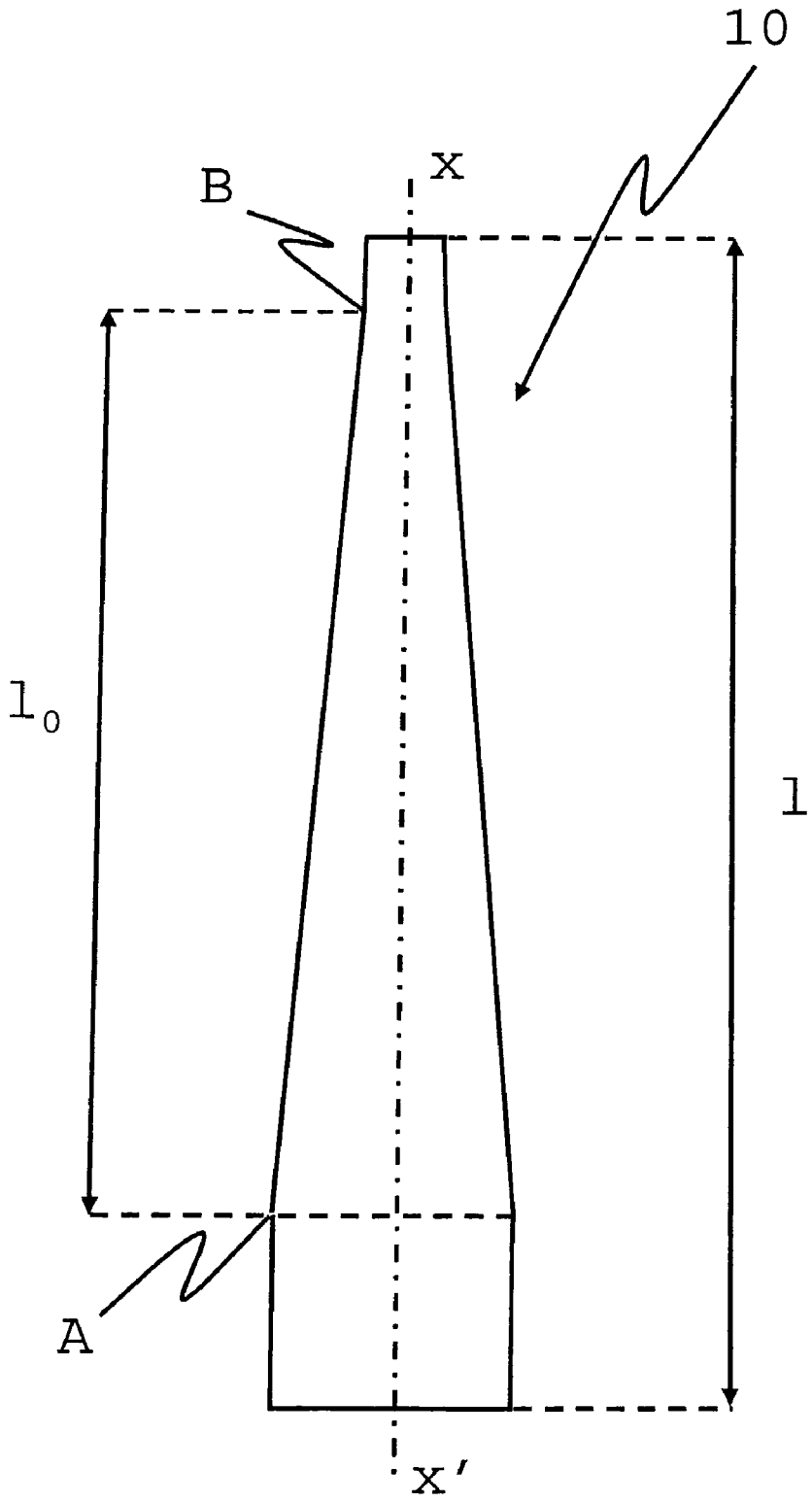
FIG. 1 and FIG. 4 represent a lateral view of a utility pole according to two different embodiments of the present invention.

FIG. 1 represents a utility pole 10 according to the present invention, having an effective cross-section area which decreases along a length portion ($l_0$) of the utility pole total length (l). Said effective cross-section area decreases from the lower end (A) to the upper end (B) of said length portion ($l_0$). x-x' represents a longitudinal axis of the utility pole (10).

Figure 2:
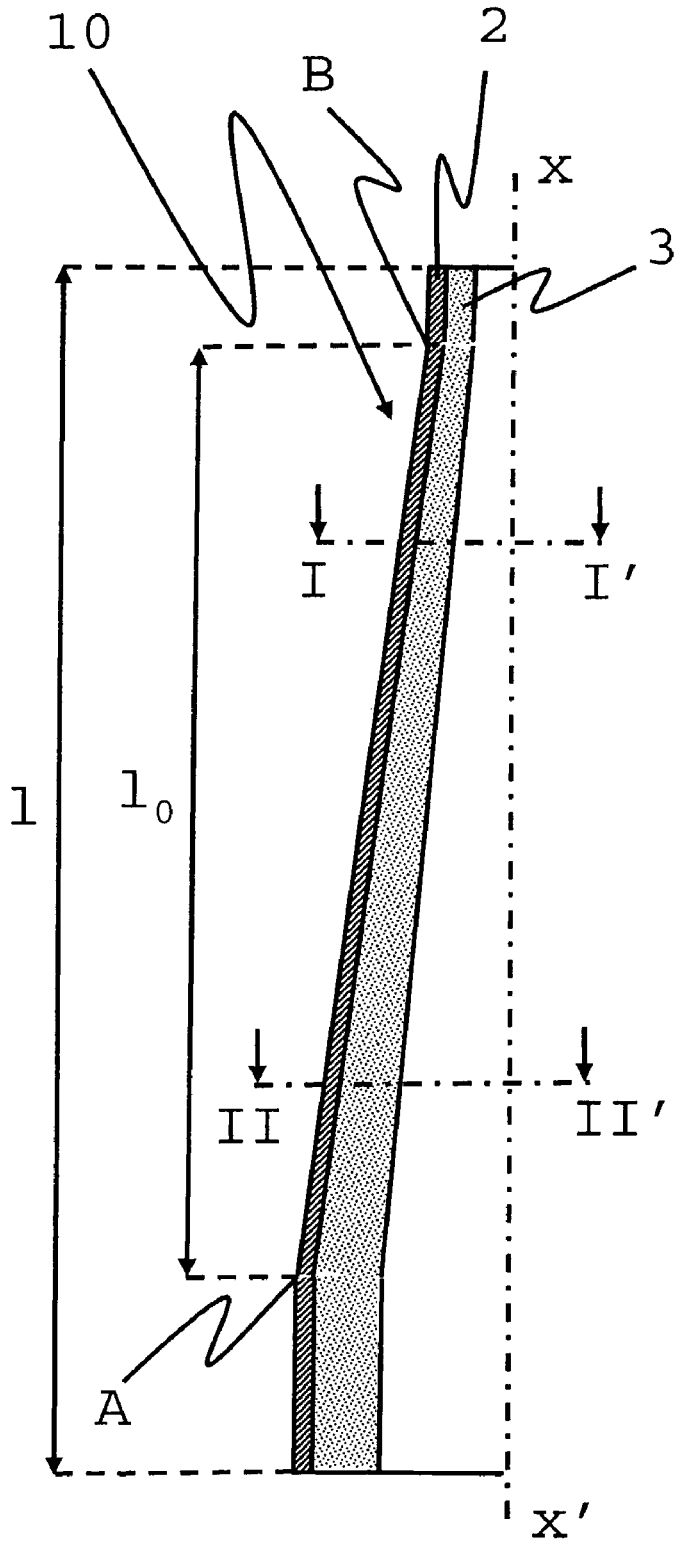
FIG. 2 represents a partial longitudinal cross-section of the utility pole of FIG. 1.

FIG. 2 represents a partial longitudinal cross-section of the utility pole (10) of FIG. 1 showing an outer coating layer (2) made by co-extrusion with the thermoplastic composite material (3) of the utility pole (10).

Figure 3:
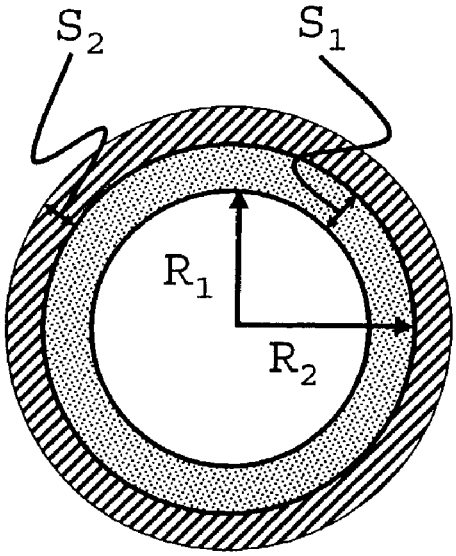
FIG. 3 represents the transversal sections obtained at I-I' and II-II' of the utility pole shown in FIG. 2.
Figure 3:
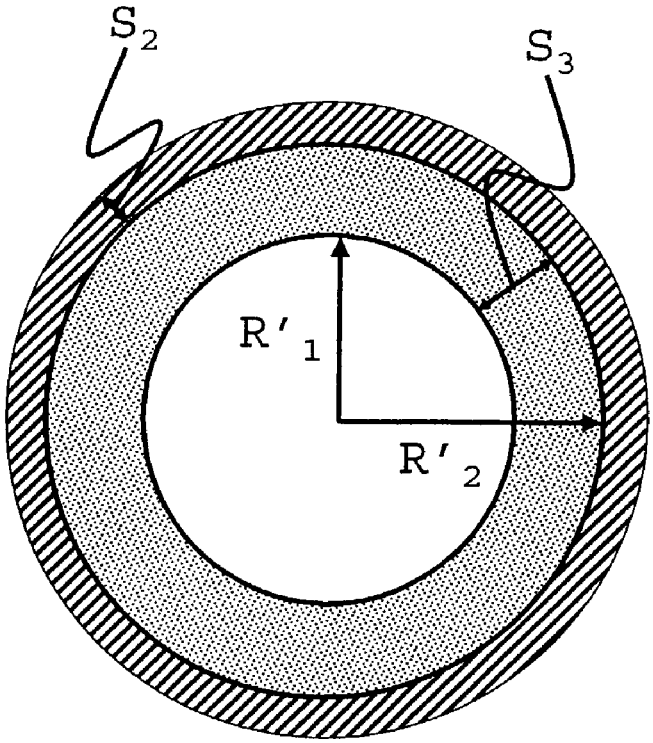

FIG. 3 represents the transversal sections obtained at I-I' and II-II' of the utility pole shown in FIG. 2. In FIG. 3: $s_2$ represents the thickness of the outer coating layer; $s_1$ and $s_3$ ($s_1<s_3$) represent the thickness of the thermoplastic composite material; $R_1$ and $R'_1$ ($R_1<R'_1$) represent the radius of the internal utility pole profile; $R_2$ and $R'_2$ ($R_2<R'_2$) represent the internal radius of the outer coating layer. As shown FIG. 3, the decreasing of the effective cross-section area along a length portion ($l_0$) of the utility pole total length (l) is obtained by varying both the external diameter of the utility pole and the thickness of the thermoplastic composite material.

Figure 4:
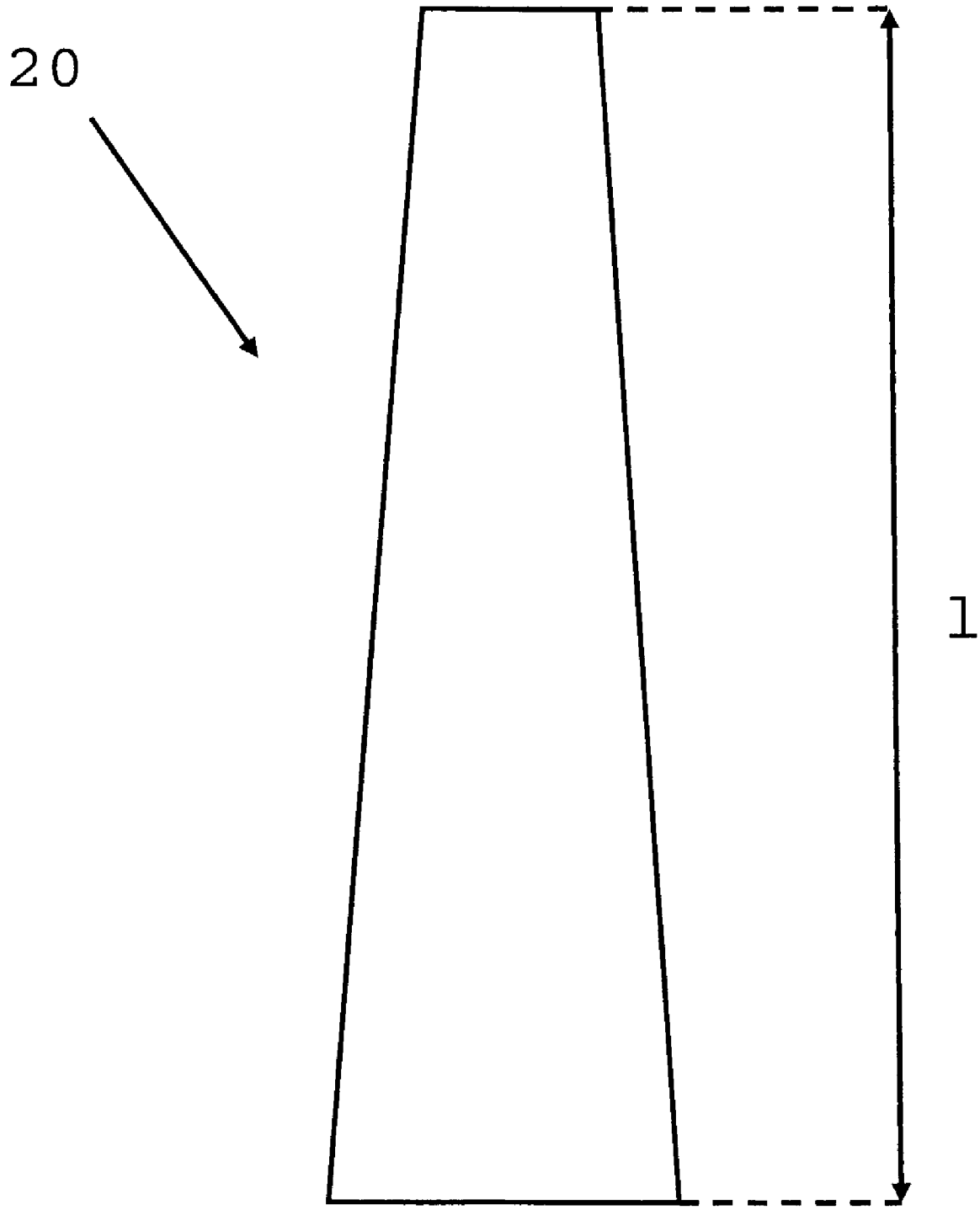

FIG. 4 represents a utility pole (20) of frusto-conical shape according to the present invention having a variable cross-sectional area along the total length (l).

The present invention will be further illustrated below by means of a number of preparation examples, which are given for purely indicative purposes and without any limitation of this invention.

EXAMPLE 1

Preparation of Utility Poles

Utility poles according to a construction scheme according to FIG. 2 were produced.

The composition of the thermoplastic composite material and of the outer coating layer of said utility pole is given in Table 1 below (the amount of the various components are expressed in percent by weight with respect to the total weight of the thermoplastic composite material).

TABLE 1

| | THERMOPLASTIC COMPOSITE MATERIAL | OUTER COATING LAYER |
|---|---|---|
| BorECO ™ BA212E | 57.5 | — |
| Hostalen ® PP H7350FLS 303064 | — | 100.0 |
| MaxiChop ® 3299 | 40.0 | — |
| Polybond ® 3200 | 2.0 | — |
| Irganox 1010 | 0.5 | — |

BorECO™ BA212E (Borealis): polypropylene heterophase copolymer having density measured, at 23° C., according to standard ISO 1183-3:1999, of 0.900 g/cm$^3$; Melt Flow Index (MFI) (measured at 230° C., with a load of 2.16 kg) of 0.30 g/10 min; melting temperature of 163° C., tensile strength, measured according to standard ISO 527-1:1993, at 23° C., at a traction speed of 50 mm/min, of 31 MPa; tensile modulus, measured according to standard ISO 527-1:1993, at 23° C., at a traction speed of 1 mm/min, of 1700 MPa;

Hostalen® PP H7350FLS 303064 (Basell): polypropylene homopolymer (containing a flame retardant) having density measured, at 23° C., according to standard ISO 1183-3:1999, of 0.924 g/cm$^3$; Melt Flow Index (MFI) (measured at 230° C., with a load of 2.16 kg) of 0.40 g/10 min; melting temperature 160° C., tensile strength, measured according to standard ISO 527-1:1993, at 23° C., at a traction speed of 50 mm/min, of 30 MPa; tensile modulus, measured according to standard ISO 527-1:1993, at 23° C., at a traction speed of 1 mm/min, of 1300 MPa;

MaxiChop® 3299(PPG Industries): E-glass fibers having average fiber length of 3.0 mm; average fiber diameter of 0.0137 mm; aspect ratio of 219;

Polybond® 3200 (Crompton): maleic anhydride grafted polypropylene;

Irganox® 1010 (Ciba Geigy): phenolic-based antioxidant.

The thermoplastic composite material above reported was obtained by mixing the various components in a co-rotating twin-screw extruder Maris TM40HT having a nominal screw diameter of 40 mm and a L/D ratio of 48. The maximum temperature in the extruder was about 210° C.

The obtained thermoplastic composite material was discharged from the extruder in the form of continuous strands, was cooled at room temperature by means of a cooling device and was granulated by means of a pelletizer.

The obtained thermoplastic composite material having a density, measured, at 23° C., according to standard ISO 1183-

3:1999, of 1.22 g/cm$^3$, was subjected to the measurement of its mechanical and physico-chemical properties.

To this aim, plates 3 mm thick were formed from the thermoplastic composite material obtained as disclosed above. The plates were prepared by moulding for 5 min, at 190° C., and subsequent cooling for 5 min to room temperature.

The plates were used for determining the following mechanical and physico-chemical characteristics:

tensile strength, measured according to standard ISO 527-1:1993 with the Instron instrument, at 23° C., at a traction speed of 5 mm/min, of 70 MPa;

tensile modulus, measured according to standard ISO 527-1:1993 with the Instron instrument, at 23° C., at a traction speed of 5 mm/min, of 7000 MPa;

specific tensile strength of 57.3 MPa/(gr/cm$^3$);

specific tensile modulus of 5737.7 MPa/(gr/cm$^3$);

heat deflection temperature (HDT), measured according to standard ISO 75-1:2004, of 145° C.

The utility poles were prepared by co-extrusion of the thermoplastic composite material and of the material of the outer coating layer (namely, the Hostalen® PP H7350FLS 303064) above reported by means of a Quick-Switch line KM-QS 160-250 by Krauss-Maffei comprising a main extruder (KME 1-125-30-B2) and an auxiliary extruder for the extrusion of the outer coating layer (KME 1-60-30-B2), said two extruders connected to a common double extrusion head.

The granules of the thermoplastic composite material obtained as reported above were fed to the extruder hopper of a KME 1-125-30 B2 extruder having a nominal screw diameter of 125 mm and a L/D ratio of 30. The maximum temperature in the extruder was 225° C. The average output was 500 kg/h. The average screw speed was 51 rpm.

The granules of the component used for the outer coating layer were fed to the extruder hopper of a KME 1-60-30-B2 extruder having a nominal screw diameter of 60 mm and a L/D ratio of 30. The maximum temperature in the extruder was 210° C. The average output was 20 kg/h. The average screw speed was 30 rpm.

The line speed rate was varied of from 0.8 m/min to 2 m/min and vice versa.

The continuous co-extrusion process was carried out to obtain utility poles having an effective cross-section area decreasing along a length portion ($l_0$) of the utility poles total length (l). In details, the continuous co-extrusion process comprises the following steps:

(a) co-extruding the thermoplastic composite material obtained as disclosed above and the material of the outer coating layer (namely, the Hostalen® PP H7350FLS 303064) to obtain an extruded profile having a substantially constant external diameter of 160 mm, a substantially constant thickness of the thermoplastic composite material of 8 mm and a length of 1 m;

(b) co-extruding the thermoplastic composite material obtained as disclosed above and the material of the outer coating layer (namely, the Hostalen® PP H7350FLS 303064), continuously varying the effective cross-section area of the extruded profile to be obtained, to obtain an extruded profile having a progressively increasing external diameter up to 250 mm, a progressively increasing thickness of the thermoplastic composite material up to 15 mm, and a length of 6.2 m;

(c) co-extruding the thermoplastic composite material obtained as disclosed above and the material of the outer coating layer (namely, the Hostalen® PP H7350FLS 303064) to obtain an extruded profile having a substantially constant external diameter of 250 mm, a substantially constant thickness of the thermoplastic composite material of 15 mm and a length of 2.6 m;

(d) co-extruding the thermoplastic composite material obtained as disclosed above and the material of the outer coating layer (namely, the Hostalen® PP H7350FLS 303064) continuously varying the effective cross-section area of the extruded profile to be obtained, to obtain an extruded profile having a progressively decreasing external diameter up to 160 mm, a progressively decreasing thickness of the thermoplastic composite material up to 8 mm, and a length of 6.2 m;

(e) repeating the steps (a) to (d);

(f) cooling the obtained extruded profile to room temperature by means of a water cooling device;

(g) cutting the obtained extruded profile in the middle portion of the obtained extruded profile having a substantially constant diameter to obtain the desired utility poles.

The thickness of the outer coating layer was about 0.5 mm.

Each utility pole so obtained had a weight of about 60 kg.

The obtained utility poles were subjected to a mechanical resistance test. To this aim, a transversal stress of 4000 N was applied at a distance of 50 cm from the upper end of the utility pole: the bending of the utility pole was lower than 1900 mm indicating that the obtained utility poles have a good mechanical resistance.

EXAMPLE 2

Preparation of Utility Poles

Utility poles according to a construction scheme similar to FIG. 2, the only difference being the fact that the outer coating layer is avoided, were produced.

The composition of the thermoplastic composite material of said utility pole is given in Table 2 below (the amount of the various components are expressed in percent by weight with respect to the total weight of the thermoplastic composite material).

TABLE 2

| | THERMOPLASTIC COMPOSITE MATERIAL |
|---|---|
| Moplen ® EP310D | 40.6 |
| Hostalen ® PP H7350FLS 303064 | — |
| CB 35 | 53.0 |
| Polybond ® 3200 | 4.0 |
| Irganox ® 1010 | 0.4 |
| Glycolube ® WP-2200 | 2.0 |

Moplen® EP310D (Basell): heterophase copolymer having density measured, at 23° C., according to standard ISO 1183-3:1999, of 0.900 g/cm$^3$; Melt Flow Index (MFI) (measured at 230° C., with a load of 2.16 kg) of 0.8 g/10 min; melting temperature of 164° C., tensile strength, measured according to standard ISO 527-1:1993, at 23° C., at a traction speed of 50 mm/min, of 27 MPa; tensile modulus, measured according to standard ISO 527-1:1993, at 23° C., at a traction speed of 1 mm/min, of 1200 MPa;

CB 35 (La.So.Le): wood fibers having a fiber length of from 0.18 mm to 0.3 mm and an aspect ratio of 2.2;

Polybond® 3200 (Crompton): maleic anhydride grafted polypropylene;

Irganox® 1010 (Ciba Geigy): phenolic-based antioxidant;

Glycolube® WP-2200 (Lonza): amide lubricant.

The thermoplastic composite material above reported was obtained by mixing the various components in a first co-rotating twin-screw extruder Maris TM40HT having a nominal screw diameter of 40 mm and a L/D ratio of 48. The maximum temperature in the extruder was about 195° C.

The obtained thermoplastic composite material was discharged from said first extruder in the form of a continuous ribbon, was fed into a second single screw extruder and subsequently granulated by means of an air pelletizer and cooled at room temperature by means of a cooling device.

The obtained thermoplastic composite material having a density, measured, at 23° C., according to standard ISO 1183-3:1999, of 1.10 g/cm$^3$, was subjected to the measurement of its mechanical and physico-chemical properties.

To this aim, plates 3 mm thick were formed from the thermoplastic composite material obtained as disclosed above. The plates were prepared by moulding for 5 min, at 190° C., and subsequent cooling for 5 min to room temperature.

The plates were used for determining the following mechanical and physico-chemical characteristics:

tensile strength, measured according to standard ISO 527-1:1993 with the Instron instrument, at 23° C., at a traction speed of 5 mm/min, of 35 MPa;

tensile modulus, measured according to standard ISO 527-1:1993 with the Instron instrument, at 23° C., at a traction speed of 5 mm/min, of 4500 MPa;

specific tensile strength of 31.8 MPa/(gr/cm$^3$);

specific tensile modulus of 4090.9 MPa/(gr/cm$^3$);

heat deflection temperature (HDT), measured according to standard ISO 75-1:2004, of 102° C.

The utility poles were prepared by extrusion of the thermoplastic composite material above reported by means of a Quick-Switch line KM-QS 160-250 by Krauss-Maffei comprising an extruder (KME 1-125-30-B2).

The granules of the thermoplastic composite material obtained as reported above were fed to the extruder hopper of a KME 1-125-30-B2 extruder having a nominal screw diameter of 125 mm and a L/D ratio of 30. The maximum temperature in the extruder was 200° C. The average output was about 500 kg/h. The average screw speed was 40 rpm.

The line speed rate was varied of from 0.4 m/min to 1.2 m/min and vice versa.

The continuous extrusion process was carried out to obtain utility poles having an effective cross-section area decreasing along a length portion ($l_0$) of the utility poles total length (l). In details, the continuous extrusion process comprises the following steps:

(a) extruding the thermoplastic composite material obtained as disclosed above to obtain an extruded profile having a substantially constant external diameter of 160 mm, a substantially constant thickness of the thermoplastic composite material of 10 mm and a length of 1 m;

(b) extruding the thermoplastic composite material obtained as disclosed above continuously varying the effective cross-section area of the extruded profile to be obtained, to obtain an extruded profile having a progressively increasing external diameter up to 250 mm, a progressively increasing thickness of the thermoplastic composite material up to 25 mm, and a length of 6.2 m;

(c) extruding the thermoplastic composite material obtained as disclosed above to obtain an extruded profile having a substantially constant external diameter of 250 mm, a substantially constant thickness of the thermoplastic composite material of 25 mm and a length of 2.6 m;

(d) extruding the thermoplastic composite material obtained as disclosed above continuously varying the effective cross-section area of the extruded profile to be obtained, to obtain an extruded profile having a progressively decreasing external diameter up to 160 mm, a progressively decreasing thickness of the thermoplastic composite material up to 10 mm, and a length of 6.2 m;

(e) repeating the steps (a) to (d);

(f) cooling the obtained extruded profile to room temperature by means of a water cooling device;

(g) cutting the obtained extruded profile in the middle portion of the obtained extruded profile having a substantially constant diameter to obtain the desired utility poles.

Each utility pole so obtained had a weight of about 96 kg.

The obtained utility poles were subjected to a mechanical resistance test. To this aim, a transversal stress of 4000 N was applied at a distance of 50 cm from the upper end of the utility pole: the bending of the utility pole was lower than 1900 mm indicating that the obtained utility poles have a good mechanical resistance.

The invention claimed is:

1. A utility pole comprising a thermoplastic composite material comprising:

(a) at least one olefin polymer; and (b) at least one reinforcing fiber material embedded in said at least one olefin polymer, said thermoplastic composite material having a specific tensile strength higher than or equal to 15 MPa/(gr/cm$^3$) and a specific tensile modulus higher than or equal to 2000 MPa/(gr/cm$^3$).

2. The utility pole according to claim 1, wherein said thermoplastic composite material has a specific tensile strength of 20 MPa/(gr/cm$^3$) to 200 MPa/(gr/cm$^3$).

3. The utility pole according to claim 2, wherein said thermoplastic composite material has a specific tensile strength of 30 MPa/(gr/cm$^3$) to 150 MPa/(gr/cm$^3$).

4. The utility pole according to claim 1, wherein said thermoplastic composite material has a specific tensile modulus of 2500 MPa/(gr/cm$^3$) to 20000 MPa/(gr/cm$^3$).

5. The utility pole according to claim 4, wherein said thermoplastic composite material has a specific tensile modulus of 3000 MPa/(gr/cm$^3$) to 15000 MPa/(gr/cm$^3$).

6. The utility pole according to claim 1, wherein said thermoplastic composite material has a heat deflection temperature higher than 80° C.

7. The utility pole according to claim 6, wherein said thermoplastic composite material has a heat deflection temperature of 90° C. to 180° C.

8. The utility pole according to claim 1, wherein said utility pole has a substantially circular cross-section.

9. The utility pole according to claim 1, wherein said utility pole has a substantially non-circular cross-section.

10. The utility pole according to claim 1, wherein said utility pole has an effective cross-section area which is substantially constant along the utility pole total length.

11. The utility pole according to claim 1, wherein said utility pole has an effective cross-section area which decreases along at least one length portion of the utility pole total length.

12. The utility pole according to claim 11, wherein the decrease of said effective cross-section area along at least one length portion of the utility pole total length is obtained by maintaining substantially constant the thickness of the thermoplastic composite material along the utility pole total length and varying the external diameter of the utility pole along at least one length portion of the utility pole total length.

13. The utility pole according to claim 11, wherein the decrease of said effective cross-section area along at least one length portion of the utility pole total length is obtained by maintaining substantially constant the external diameter along the utility pole total length and varying the thickness of the thermoplastic composite material along at least one length portion of the utility pole total length.

14. The utility pole according to claim 11, wherein the decrease of said effective cross-section area along at least one length portion of the utility pole total length is obtained by varying both the external diameter of the utility pole along at least one length portion of the utility pole total length and the thickness of the thermoplastic composite material along at least one length portion of the utility pole total length.

15. The utility pole according to claim 11, wherein said length portion is 20% to 100% with respect to the utility pole total length.

16. The utility pole according to 15, wherein said length portion is 40% to 90% with respect to the utility pole total length.

17. The utility pole according to claim 11, wherein said effective cross-section area decreases from the lower end to the upper end of said at least one length portion.

18. The utility pole according to 17, wherein said effective cross-section area continuously decreases from the lower end to the upper end of said at least one length portion.

19. The utility pole according to claim 11, wherein said utility pole has a frusto-conical external shape.

20. The utility pole according to claim 1, wherein said utility pole has a height of 6 m to 10 m and an effective cross-section area having a value of 1000 $mm^2$ to 30000 $mm^2$.

21. The utility pole according to claim 20, wherein said effective cross-section area has a value of 2000 $mm^2$ to 20000 $mm^2$.

22. The utility pole according to claim 1, wherein said at least one olefin polymer (a) has a melting temperature higher than or equal to 115° C.

23. The utility pole according to claim 22, wherein said at least one olefin polymer (a) has a melting temperature of 130° C. to 200° C.

24. The utility pole according to claim 1, wherein said at least one olefin polymer (a) has a tensile strength, measured according to standard ISO 527-1:1993, at 23° C., higher than or equal to 20 MPa.

25. The utility pole according to claim 24, wherein said at least one olefin polymer (a) has a tensile strength, measured according to standard ISO 527-1:1993, at 23° C., of 25 MPa to 50 MPa.

26. The utility pole according to claim 1, wherein said at least one olefin polymer (a) has a tensile modulus, measured according to standard ISO 527-1:1993, at 23° C., higher than or equal to 800 MPa.

27. The utility pole according to claim 26, wherein said at least one olefin polymer (a) has a tensile modulus, measured according to standard ISO 527-1:1993, at 23° C., of 1000 MPa to 2500 MPa.

28. The utility pole according to claim 1, wherein said at least one olefin polymer (a) has a density measured, at 23° C., according to standard ISO 1183-3:1999, higher than or equal to 0.830 g/$cm^3$.

29. The utility pole according to claim 28, wherein said at least one olefin polymer (a) has a density measured, at 23° C., according to standard ISO 1183-3:1999, of 0.890 g/$cm^3$ to 1.20 g/$cm^3$.

30. The utility pole according to claim 1, wherein said at least one olefin polymer (a) has a Melt Flow Index, measured according to standard ASTM D1238-00, of 0.05 g/10 min to 15 g/10 min.

31. The utility pole according to claim 30, wherein said at least one olefin polymer (a) has a Melt Flow Index, measured according to standard ASTM D1238-00, of 0.1 g/10 min to 10 g/10 min.

32. The utility pole according to claim 1, wherein said at least one olefin polymer (a) is present in the thermoplastic composite material in an amount of 30% by weight to 95% by weight with respect to the total weight of the thermoplastic composite material.

33. The utility pole according to claim 32, wherein said at least one olefin polymer (a) is present in the thermoplastic composite material in an amount of 35% by weight to 80% by weight with respect to total weight of the thermoplastic composite material.

34. The utility pole according to claim 1, wherein said at least one olefin polymer (a) is selected from aliphatic and/or aromatic olefin homopolymers or copolymers, or mixtures thereof.

35. The utility pole according to claim 34, wherein said aliphatic olefin homopolymers of copolymers are selected from: high-density polyethylene (d=0.940-0.970 g/$cm^3$), propylene homopolymers or copolymers of propylene with ethylene and/or with at least one α-olefin comonomer having the following formula $CH_2$—CH—R, in which R represents a linear or branched alkyl group containing 4 to 12 carbon atoms, with an overall content of ethylene and/or α-olefin lower than 10% by mole, or mixtures thereof.

36. The utility pole according to claim 35, wherein said aliphatic olefin homopolymers or copolymers are copolymers of propylene with ethylene, or mixtures thereof.

37. The utility pole according to claim 34, wherein said aromatic olefin homopolymers or copolymers are selected from: polystyrene, ethylene/styrene copolymers, or mixtures thereof.

38. The utility pole according to claim 37, wherein said aromatic olefin homopolymers or copolymers are polystyrene.

39. The utility pole according to claim 34, wherein said aliphatic and/or aromatic olefin copolymers are selected from heterophase comprising a thermoplastic phase made from homopolymers of one or more aliphatic or aromatic olefins and an elastomeric phase made from a copolymer of ethylene with an α-olefin, wherein said elastomeric phase is preferably present in an amount not higher than 40% by weight relative to the total weight of the heterophase copolymer, or mixtures thereof.

40. The utility pole according to claim 1, wherein said at least one reinforcing fiber material (b) has an average length lower than or equal to 5 mm.

41. The utility pole according to claim 40, wherein said at least one reinforcing fiber material (b) has an average length of 0.01 mm to 4 mm.

42. The utility pole according to claim 1, wherein said at least one reinforcing fiber has an aspect ratio higher than 2.

43. The utility pole according to claim 42, wherein said at least one reinforcing fiber has an aspect ratio of from 3 to 1000.

44. The utility pole according to claim 1, wherein said at least one reinforcing fiber material (b) is selected from discontinuous fibers, glass fibers, wood fibers, cellulosic fibers, aramid fibers, carbon fibers, or mixtures thereof.

45. The utility pole according to claim 44, wherein said at least one reinforcing fiber material (b) is selected from glass fibers, wood fibers, or mixtures thereof.

46. The utility pole according to claim 1, wherein said at least one reinforcing fiber material (b) is present in the thermoplastic composite material in an amount of 5% by weight to 70% by weight with respect to the total weight of the thermoplastic composite material.

47. The utility pole according to claim 46, wherein said at least one reinforcing fiber material (b) is present in the thermoplastic composite material in an amount of 20% by weight to 65% by weight with respect to the total weight of the thermoplastic composite material.

48. The utility pole according to claim 1, wherein said thermoplastic composite material further comprises at least one compatabilizing agent (c).

49. The utility pole according to claim 48, wherein said at least one compatibilizing agent (c) is selected from functionalized aliphatic and/or aromatic olefin homopolymers or copolymers containing functional groups selected from: carboxylic groups, anhydride groups, ester groups, silane groups, and epoxy groups.

50. The utility pole according to claim 48, wherein said at least one compatibilizing agent (c) is present in the thermoplastic composite material in an amount of 0% by weight to 10% by weight with respect to the total weight of the thermoplastic composite material.

51. The utility pole according to claim 1, wherein said thermoplastic composite material further comprises at least one copolymer of ethylene with at least one aliphatic α-olefin or at least one copolymer of ethylene with at least one aliphatic α-olefin and a diene (d).

52. The utility pole according to claim 51, wherein said at least one copolymer of ethylene with at least one aliphatic α-olefin or at least one copolymer of ethylene with at least one aliphatic α-olefin and a diene (d) has a molecular weight distribution index of less than 5 and a melting enthalpy of not less than 30 J/g.

53. The utility pole according to claim 51, wherein said at least one copolymer of ethylene with at least one aliphatic α-olefin, or at least one copolymer of ethylene with at least one aliphatic α-olefin and a diene (d) is present in the thermoplastic composite material in an amount of 0% by weight to 30% by weight with respect to the total weight of the thermoplastic composite material.

54. A thermoplastic composite material comprising:

(a) at least one olefin polymer; and (b) at least one reinforcing fiber material embedded in said at least one olefin polymer, said thermoplastic composite material having a specific tensile strength higher than or equal to 15 MPa/(gr/cm$^3$) and a specific tensile modulus higher than or equal to 2000 MPa/(gr/cm$^3$).

55. The thermoplastic composite material according to claim 54, wherein said thermoplastic composite material has a specific tensile strength of 20 MPa/(gr/cm$^3$) to 200 MPa/(gr/cm$^3$).

56. The thermoplastic composite material according to claim 55, wherein said thermoplastic composite material has a specific tensile strength of 30 MPa/(gr/cm$^3$) to 150 MPa/(gr/cm$^3$).

57. The thermoplastic composite material according to claim 54, wherein said thermoplastic composite material has a specific tensile modulus of 2500 MPa/(gr/cm$^3$) to 20000 MPa/(gr/cm$^3$).

58. The thermoplastic composite material according to claim 57, wherein said thermoplastic composite material has a specific tensile modulus of 3000 MPa/(gr/cm$^3$) to 15000 MPa/(gr/cm$^3$).

59. The thermoplastic composite material according to claim 54, wherein said thermoplastic composite material has a heat deflection temperature higher than 80° C.

60. The thermoplastic composite material according to claim 59, wherein said thermoplastic composite material has a heat deflection temperature of 90° C. to 180° C.

61. The thermoplastic composite material according to claim 54, wherein said at least one olefin polymer (a):

has a melting temperature higher than or equal to 115° C.; or has a tensile strength, measured according to standard ISO 527-1:1993, at 23° C., higher than or equal to 20 MPa; or has a tensile modulus, measured according to standard ISO 527-1:1993, at 23° C., higher or equal to 800 MPa; or has a density measured, at 23° C., according to standard ISO 1183-3:1999, higher than or equal to 0.830 g/cm$^3$; or has a Melt Flow Index, measured according to standard ASTM D1238-00, of 0.05 g/10 min to 15 g/10 min; or is present in the thermoplastic composite material in an amount of 30% by weight to 95% by weight with respect to the total weight of the thermoplastic composite material; or is selected from aliphatic and/or aromatic olefin homopolymers or copolymers, or mixtures thereof; or is selected from aliphatic olefin homopolymers or copolymers selected from: high-density polyethylene (d=0.940-0.970 g/cm$^3$), propylene homopolymers or copolymers of propylene with ethylene and/or with at least one α-olefin comonomer having the following formula $CH_2{=}CH{-}R$, in which R represents a linear or branched alkyl group containing from 4 to 12 carbon atoms, with an overall content of ethylene and/or α-olefin lower than 10% by mole, or mixtures thereof; or is selected from copolymers of propylene with ethylene, or mixtures thereof; or is selected from polystyrene, ethylene/styrene copolymers, or mixtures thereof; or is selected from aliphatic and/or aromatic olefin copolymers selected from heterophase copolymers comprising a thermoplastic phase made from a homopolymer of one or more aliphatic or aromatic olefins and an elastomeric phase made from a copolymer of ethylene with an α-olefin, wherein said elastomeric phase is preferably present in an amount not higher than 40% by weight relative to the total weight of the heterophase copolymer, or mixtures thereof.

62. The thermoplastic composite material according to claim 54, wherein said at least one reinforcing fiber material (b):

has an average length lower than or equal to 5 mm; or has an aspect ratio higher than 2; or is selected from discontinuous fibers, glass fibers, wood fibers, cellulosic fibers, aramid fibers, carbon fibers, or mixtures thereof; or is present in the thermoplastic composite material in an amount of 5% by weight to 70% by weight with respect to the total weight of the thermoplastic composite material.

63. The thermoplastic composite material according to claim 54, wherein said thermoplastic composite material further comprises at least one compatabilizing agent (c):

selected from functionalized aliphatic and/or aromatic olefin homopolymers or copolymers containing functional groups selected from: carboxylic groups, anhydride groups, ester groups, silane groups, and epoxy groups; or is present in the thermoplastic composite material in an amount of 0% by weight to 10% by weight with respect to the total weight of the thermoplastic composite material.

64. The thermoplastic composite material according to claim 54, wherein said thermoplastic composite material further comprises:

at least one copolymer of ethylene with at least one aliphatic α-olefin, or at least one copolymer of ethylene with at least one aliphatic α-olefin and a diene (d); or at least one copolymer of ethylene with at least one aliphatic α-olefin, or at least one copolymer of ethylene with at least one aliphatic α-olefin and a diene (d) having a molecular weight distribution index of less than 5 and a melting enthalpy of not less than 30 J/g; or at least one copolymer of ethylene with at least one aliphatic α-olefin, and or at least one copolymer of ethylene with at least one aliphatic α-olefin and a diene (d) present in the thermoplastic composite material in an amount of 0% by weight to 30% by weight with respect to the total weight of the thermoplastic composite material.

65. A process for manufacturing a utility pole according to claim 1, comprising:

feeding a thermoplastic composite material into at least one extruder comprising a housing, at least one screw rotatably mounted into said housing comprising at least one feed opening and a discharge opening;

mixing and melting said composite material;

extruding the melted composite material through a variable extrusion die head to obtain an extruded profile;

calibrating the extruded profile by means of a calibrating device;

cooling the extruded profile; and cutting the extruded profile to obtain the utility pole.

66. The process according to claim 65, wherein said extrusion process is carried out continuously.

67. The process according to claim 65, wherein said mixing and melting step is carried out at a temperature of 160° C. to 240° C.

68. The process according to claim 67, wherein said mixing and melting step is carried out at a temperature of 170° C. to 230° C.

69. The process according to claim 65, wherein said extrusion process further comprises the step of extruding at least one coating layer onto said extruded profile.

70. The utility pole according to claim 1, comprising a telecommunication pole.

* * * * *